US006138778A

United States Patent [19]

Price et al.

[11] Patent Number: 6,138,778

[45] Date of Patent: Oct. 31, 2000

[54] ROCK BIT LUBRICANT RELIEF VALVE

[75] Inventors: Randall Ray Price, Houston; Walter Scott Dillard, Pasadena, both of Tex.

[73] Assignee: Camco International Inc., Houston, Tex.

[21] Appl. No.: 09/378,091

[22] Filed: Aug. 20, 1999

[51] Int. Cl.[7] ..... E21B 10/22

[52] U.S. Cl. ..... 175/228; 137/493.9

[58] Field of Search ..... 175/228, 227, 175/229; 384/93; 137/493.9, 493

[56] References Cited

U.S. PATENT DOCUMENTS

| | | | |
|---|---|---|---|
| 2,743,737 | 5/1956 | Textor | 137/493 |
| 3,007,751 | 11/1961 | Eenink . | |
| 3,048,230 | 8/1962 | Angel . | |
| 3,150,683 | 9/1964 | Carolan | 137/493 |
| 3,230,019 | 1/1966 | Kotch et al. . | |
| 3,230,020 | 1/1966 | Gilbert et al. . | |
| 3,476,195 | 11/1969 | Galle . | |
| 3,721,306 | 3/1973 | Sartor . | |
| 3,847,234 | 11/1974 | Schumacher, Jr. et al. . | |
| 3,942,596 | 3/1976 | Millsapps, Jr. . | |
| 4,019,785 | 4/1977 | Stinson et al. . | |
| 4,055,225 | 10/1977 | Millsapps . | |
| 4,161,223 | 7/1979 | Oelke . | |
| 4,199,856 | 4/1980 | Farrow et al. . | |
| 4,276,946 | 7/1981 | Millsapps, Jr. . | |
| 4,335,791 | 6/1982 | Evans . | |
| 4,386,667 | 6/1983 | Millsapps, Jr. . | |
| 4,388,984 | 6/1983 | Oelke . | |
| 4,407,375 | 10/1983 | Nakamura . | |
| 4,552,228 | 11/1985 | Evans et al. . | |
| 4,577,705 | 3/1986 | Cross . | |
| 4,593,775 | 6/1986 | Chaney et al. . | |
| 4,597,455 | 7/1986 | Walters et al. . | |
| 4,727,942 | 3/1988 | Galle et al. . | |
| 4,865,136 | 9/1989 | White . | |
| 4,887,675 | 12/1989 | Shotwell . | |
| 4,942,930 | 7/1990 | Millsapps, Jr. . | |
| 5,072,795 | 12/1991 | Delgado et al. . | |
| 5,490,570 | 2/1996 | Millsapps, Jr. . | |
| 5,520,257 | 5/1996 | Crews . | |
| 5,558,172 | 9/1996 | Millsapps, Jr. . | |
| 5,623,958 | 4/1997 | Bumpers | 137/493.9 |
| 5,941,391 | 8/1999 | Jury | 137/493.9 |

*Primary Examiner*—David Bagnell
*Assistant Examiner*—Joselynn Z Sliteris

[57] ABSTRACT

The present invention is a low differential pressure relief valve made up of a valve body and an elastic membrane for downhole tools, especially rolling cutter drill bits. An aperture is formed in the membrane and a valve body with protruding end stops is mounted in the aperture. The thickness and shape of the valve body are such that the aperture is stretched when assembled. The amount the membrane is stretched and the geometry of the protruding end stop, control the differential relief pressure. The valve body and each end stop can be designed so that the pressure relief setting will be different, depending upon which side of the membrane has the higher pressure. The relief device may be adapted to be integral with existing elastic membrane type lubricant pressure compensation devices for downhole tools.

9 Claims, 4 Drawing Sheets

ROCK BIT LUBRICANT RELIEF VALVE

BACKGROUND OF THE INVENTION

1. Field of the Invention

This invention relates to tools used for mineral recovery from the earth. In particular, the present invention is a novel pressure relief device for lubricants sealed in rolling cutter earth boring drill bits.

2. Description of the Related Art

Modern day rolling cutter earth boring bits are typically used for drilling wells for the recovery of oil, gas and other minerals from the earth. Most rolling cutter drill bits used for deep well drilling typically have a sealed bearing system filled with a lubricant. Bits of this type have been used for many years in the oil and gas well drilling industry and are well known.

In order for sealed rolling cutter drill bits to operate effectively when drilling these deep wells, a means must be provided in the bit's lubrication system to equalize the pressure between the lubricant sealed within the bit and the drilling fluid outside. A pressure equalization device is also helpful in reducing pressure fluctuations near the dynamic seal during operation. These pressure fluctuations are caused by the piston effect of the rolling cutter as it moves axially on the bearing shaft during operation due to normal bearing clearances.

Pressure equalization devices in rolling cutter drill bits may utilize slidable pistons, bellows devices, or resilient diaphragms or membranes. The common trait of all pressure equalizing devices for drill bits is that they are able to displace a volume of lubricant in response to pressure differentials.

Exemplary pressure equalizing devices for rolling cutter drill bits are described in U.S. Pat. Nos. 3,007,751, 3,048,230, 3,230,319, 3,230,020, 3,721,306, 3,917,028, 4,055,225, 4,276,946, 4,335,791, 4,407,375, 4,552,228, 4,577,705, 4,597,455, 4,942,930, 5,490,570, and 5,558,172 all herein incorporated by reference for all they disclose.

For maximum effectiveness, it is desirable for the lubricant pressure-equalizing device to have the ability to displace a large volume of lubricant in a lubricant reservoir. However, because there is limited space available in the bodies of rolling cutter drill bits for lubricant reservoirs, the reservoir volume is often much smaller than what is desirable.

The most commonly used way to reduce the lubricant reservoir volume and still effectively control the pressure differentials between the lubricant and the drilling fluid is to utilize lubricant pressure relieving devices. A typical pressure relieving device allows a volume of lubricant to be released from the bit when a predetermined differential pressure is exceeded. A lubricant system that utilizes a relief valve can allow nearly the entire volume of the reservoir to be filled with lubricant during assembly. Should the lubricant volume expand beyond the limit of movement of the compensating device, lubricant is expelled.

A common way of accomplishing lubricant expulsion is through mechanical relief valves. Mechanical lubricant pressure relief devices for rolling cutter drill bits are shown in U.S. Pat. Nos. 3,476,195, 3,942,596, 4,019,785, 4,161,223, 4,388,984, 4,593,775, 4,865,136, all herein incorporated by reference for all they disclose. Mechanical relief valves, however, tend to become packed with fine abrasive particles from the drilling fluid. When the valves clog up, they no longer relieve the lubricant at a predictable pressure differential.

Mechanical valves are also subject to the extreme accelerations and vibrations experienced by the rolling cutter drill bit as it drills into the earth. These forces can cause the operating mechanisms in the mechanical relief valves to unseat, releasing lubricant or allowing the ingress of drilling fluid. The relieving pressures must be set high enough, typically above 150 PSI differential (PSID), to keep the valve firmly seated in the presence of these vibrations. Also, if abrasive particles have been trapped in the passageways of the valve, these particles can become lodged in the valve seats, holding the valve open, and allowing an undesirable exchange of lubricant, and drilling fluids.

Another means of accomplishing lubricant expulsion in rolling cutter drill bits utilizes the elasticity of the pressure compensation membrane, as shown in U.S. Pat. Nos. 3,847,234, 4,727,942, 4,887,675, and 5,072,795 all herein incorporated by reference for all they disclose. In these patents, an aperture is formed in a portion of the membrane. The aperture is held closed by the elasticity of the membrane material. It remains closed until the differential pressure of the lubricant stretches the membrane and opens the aperture, allowing lubricant to be released.

There are several advantages of this design over mechanical relief valves. Because the aperture is integral with the pressure compensation membrane, it is not particularly affected by bit vibrations. Therefore, this type of relief mechanism is not prone to opening during the excessive mechanical vibrations that occur in rolling cutter drill bits. The manner of operation of the relief valve in the membrane minimizes its likelihood for becoming clogged with the abrasives, and being held open by these abrasives.

A further advantage of this type pressure compensating membrane with an integral pressure relief device is that two-way pressure relief is possible. As explained in U.S. Pat. Nos. 3,847,234 and 5,072,795 (referenced above), there are times when it is advantageous for a relief device to allow drilling fluid into the bit during operation. When lubricant is lost from the bearing during operation, very high-pressure differentials may occur when the lubricant reservoir becomes depleted. These very high pressure differentials lead to rapid failure of the dynamic seal in the rolling cutter, and the consequent failure of the bit. If drilling fluid is allowed to enter, the high pressure differentials do not occur, and failure of the bit is delayed.

A disadvantage of the design shown in the '234 and '795 Patents is that very small differences in the aperture geometry cause large changes in the relief pressures. Since the aperture of the '234 and '795 Patents is traditionally made by forming a slit in the membrane with a puncture tool, factors such as tool wear, placement of the parts while puncturing, and direction of puncture all affect relief pressure. Pressure variations of +/−50 PSI are common. Consequently, the average relief pressure must be set to a fairly high value of about 125 PSID or more.

Even when the manufacturing variations are carefully controlled, and the relief pressures are set lower than about 80 PSID, the lubricant tends to 'bleed' or leak slowly through the aperture. It is believed that at the lower relief pressure settings, there is not enough elastic closure force on the aperture to prevent small amounts of lubricant and/or drilling fluids from entering the aperture. When the membrane moves in response to a differential pressure, the lubricant trapped in the aperture is squeezed out, resulting in, effectively, a slow leak.

In rolling cutter drill bits utilizing volume compensating rigid face seals, such as shown in U.S. Pat. No. 5,875,861 herein incorporated by reference for all it discloses, it is desirable to reduce the lubricant relief setting to a very low value, typically less than about 50 PSID. Reducing the relief pressure helps prevent the seal assembly from losing its ability for volume compensation.

The lubricant pressure relief devices described above work very well with packing ring type seals, and with self-relieving face type seals. Unfortunately, as stated above existing pressure relief devices typically need to be set above 125 PSID for reliable operation.

Many other types of down hole tools such as down hole motors, MWD tools, powered wellbore deviation tools, etc., also have sealed lubricants with pressure compensation and pressure relief devices. Any of these devices may also potentially benefit from a reliable low differential lubricant pressure relief valve.

BRIEF SUMMARY OF THE INVENTION

The present invention is a low differential pressure relief valve for downhole tools, especially rolling cutter drill bits. An aperture is formed in the membrane and a valve body with protruding end stops is mounted in the aperture. In one embodiment, the space between the end stops is greater than the thickness of the membrane. The thickness and shape of the valve body are such that the aperture is stretched when assembled. The amount the membrane is stretched and the geometry of the protruding end stop control the differential relief pressure. The valve body and each end stop can be designed so that the pressure relief setting will be different, depending upon which side of the membrane has the higher pressure. The relief device may be adapted to be integral with existing elastic membrane type lubricant pressure compensation devices for downhole tools. Differential relief pressures may be reliably set at as low as 37 PSI differential or less with a repeatability of +/−3 PSI.

The relief valve arrangement may be in a rolling cutter rock drill bit with a bit body, a lubricant reservoir formed in the bit body, a rolling cutter mounted upon the bit body, and a dynamic seal sealingly disposed between the rolling cutter and the bit body. Within the bit is a lubricant, passaging within the bit body to effect fluid communication of the lubricant between the reservoir and the dynamic seal and an elastic membrane mounted on the bit body. The membrane has a first side in fluid communication with the lubricant and a second side adapted for fluid communication with a drilling fluid. An aperture is formed in the membrane, and a valve is mounted in the aperture.

The valve has an elongated body with a first end, a second end, a surface, and a longitudinal axis. There is a protuberance on each of the ends of the valve, and the protuberance extends a radial distance beyond the surface of the body with respect to the longitudinal axis of the body.

However, the same relief valve arrangement may be suitable for many other downhole tools that utilize lubricants.

DETAILED DESCRIPTION OF THE INVENTION AND THE PREFERRED EMBODIMENT

Figure 1:
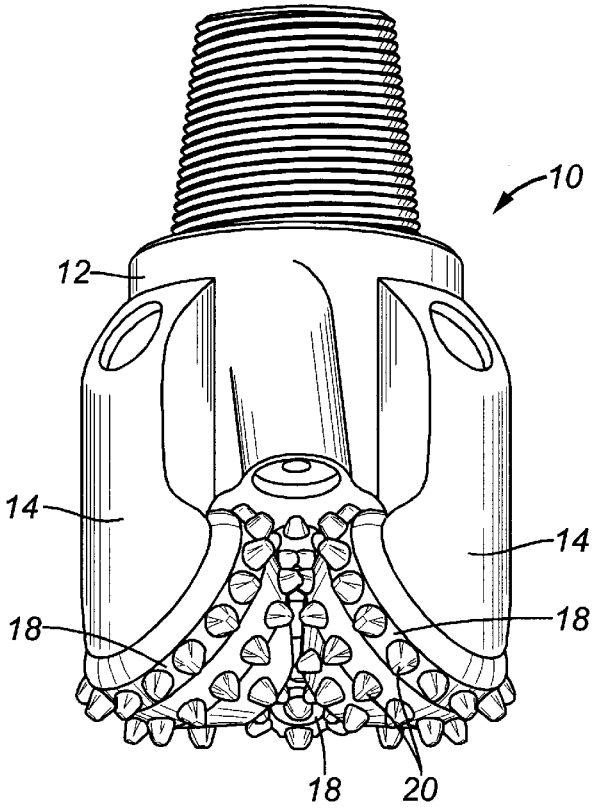
FIG. 1 is a perspective view of a rolling cutter drill bit of the present invention.
Figure 2:
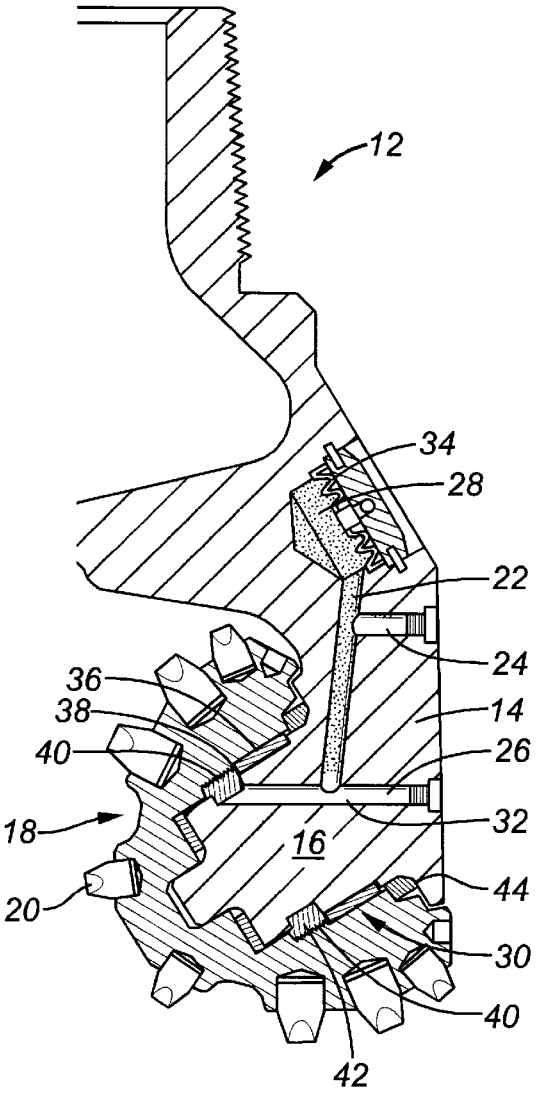
FIG. 2 is a cut away view of a rolling cutter drill bit of FIG. 1, showing a typical lubricant delivery system.

Referring now to the drawings in more detail, and particularly to FIGS. 1 and 2, a rolling cutter rock drill bit 10 includes a body 12 with a plurality of leg portions 14. Rolling cutter rock drill bits 10 are also known as rock bits and as rolling cutter earth boring bits. A cantilevered bearing shaft 16 formed on each leg 14 extends inwardly and downwardly. A rolling cutter 18 is rotatably mounted upon the bit body 12, on the cantilevered bearing shaft 16. Attached to the rolling cutter 18 are hard, wear resistant cutting inserts 20 which engage the earth to effect a drilling action and cause rotation of the rolling cutter 18. A friction bearing member 36 is mounted between the bearing shaft 16 and a mating bearing cavity 38 formed in the cutter 18. This friction bearing 36 is designed to carry the radial loads imposed upon the cutter 18 during drilling. A retention bearing member 42 is configured as a split threaded ring which engages internal threads 40 in the cutter 18. This retention bearing member 42 serves to retain the cutter 18 upon the bearing shaft by resisting the forces which tend to push the cutter 18 off the bearing shaft 16 during drilling.

Internal passaging 22, 24, & 26, as well as a lubricant reservoir 28 and bearing area 30 of the leg 14, are filled with lubricant 32 during bit assembly. The lubricant helps reduce bearing friction and wear during bit operation. The lubricant 32 is retained within the cutter 18 by a dynamic seal 44, which is sealingly disposed between the rolling cutter 18 and the bit body 12. The internal passaging 22, 24, & 26 is configured such that there is fluid communication of the lubricant between the reservoir 28, the bearing area 30, and the dynamic seal 44.

An elastic membrane 34 is fitted in the reservoir 28 and separates the lubricant 32 from the drilling fluid (not shown)

which surrounds the bit 10 during operation. The membrane 34 may be formed of any elastic material; however, molded elastomeric rubber materials are preferred. Although the elastic membrane 34 shown herein is configured as an undulating diaphragm, numerous alternative elastic membrane 34 configurations are possible. As is shown in FIG. 2, the membrane 34 is in fluid communication with the lubricant 32.

Figure 3:
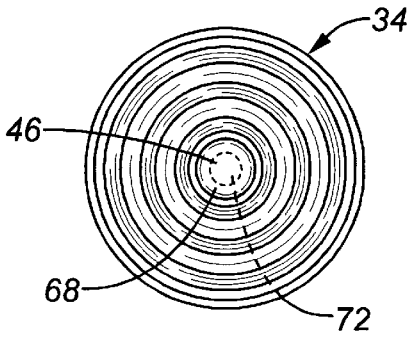
FIG. 3 is an end view of a membrane and relief valve of the preferred embodiment of the present invention.
Figure 4:
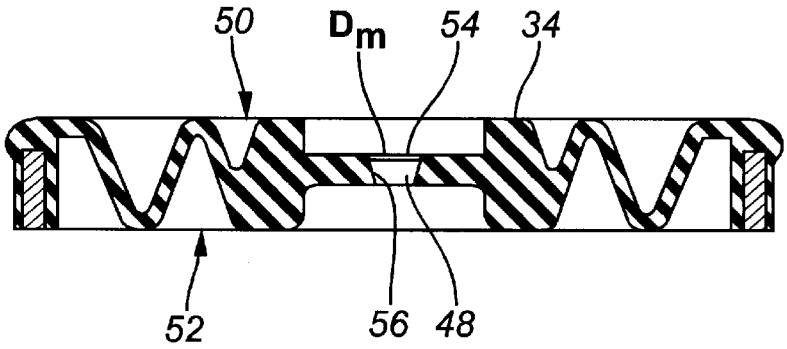
FIG. 4 is a cross-section view of the membrane portion of the preferred embodiment, showing the configuration of the preferred aperture.
Figure 5:
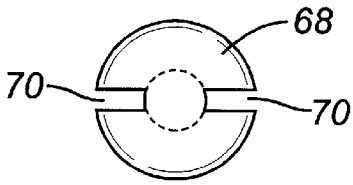
FIG. 5 is an end view of the valve component of the preferred embodiment showing the preferred slot arrangement.

FIG. 3 is an end view of the elastic membrane 34 and a relief valve 46 of the preferred embodiment of the present invention. A cross sectional view of the membrane 34 is shown enlarged in FIG. 4. The membrane 34 has a first side 50 which is exposed to and in fluid communication with the lubricant 32. The membrane 34 has a second side 52 which is exposed to and in fluid communication with the drilling fluid (not shown) which surrounds the bit in operation. The drilling fluid is also known as drilling mud or simply as mud.

Figure 12:
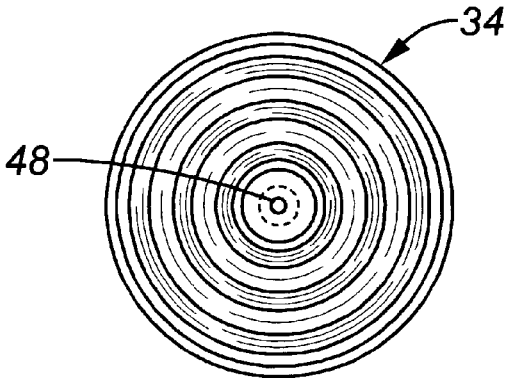
FIG. 12 is an end view of the membrane showing the preferred aperture configuration.

In the membrane 34 is formed an aperture 48. In the preferred embodiment shown in FIGS. 4, 10, and 12, the aperture 48 is in the form of a truncated cone, with the large end 54 of the cone formed on the lubricant first side 50 of the membrane 34. The large end 54 of the aperture 48 has a maximum diameter Dm, which in the preferred embodiment is about 0.120 inches. The small end of the cone 56 is on the mud second side 52 of the membrane 34, and in the preferred embodiment has a diameter of about 0.084 inches. There are numerous methods to form the conical aperture 48 shown in FIG. 4. However, a 3 mm medical biopsy tool, such as a MILTEXT Part No. 33-32 biopsy punch, centered on the membrane 34 and forced through the membrane was found to create a suitable conical aperture 48.

Figure 9:
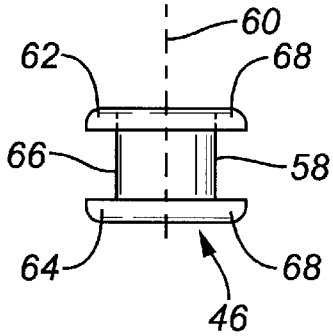
FIG. 9 is a side view of the valve of the preferred embodiment.
Figure 10:
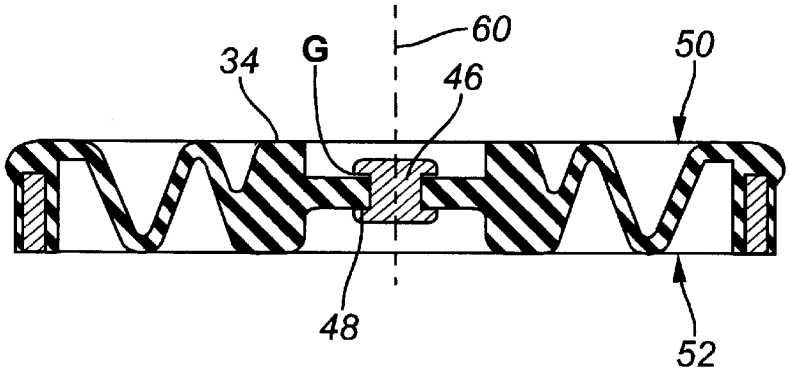
FIG. 10 is a cross-section view of the preferred arrangement of the valve mounted in the membrane.

A side view of the valve 46 is shown in FIG. 9. The valve 46 has an elongated body 58, a longitudinal axis 60 a first end 62 and a second end 64. In the preferred embodiment, the body 58 of the valve 46 is cylindrically shaped with a diameter greater than the diameter Dm of the large end 54 of the aperture 48 in the membrane 34. As shown in FIG. 10, the valve 46 is inserted into the aperture 48 of the membrane 34 at assembly to effect a relief valve assembly. The valve 46 may be made of any suitable engineering material such as a steel alloy, copper, aluminum, or other metals or organic materials or plastics. The valve 46 of the preferred embodiment, however, is made from a plastic material known in the industry as TORLON® polyamide-imide manufactured by Amoco Performance Products, Inc.

The body 58 of the valve 46 has a surface 66 which sealingly engages the membrane 34 by stretching the membrane 34 when installed in the aperture 48 upon assembly. Each end 62, 64 of the body 58 has a protuberance 68 which extends a radial distance beyond the surface 66 of the body 58 of the valve 46. For convenience of notation in this specification, the first end 62 of the valve 46 is defined as the end that is installed adjacent to the lubricant first side 50 of the membrane 34. The second end 64 of the valve 46 is defined as the end that is installed adjacent to the mud second side 52 of the membrane 34.

The configuration of the protuberance and the geometry of the valve 46 and aperture 48 determine the pressure relief characteristics. The protuberances 68 on the ends 62, 64 of the valve 46 may both have either the same configuration to effect similar relief pressures regardless of which side 50, 52 of the membrane 34 has the higher pressure. Alternately and preferably the protuberances 68 on the ends 62, 64 of the valve 46 will have different configurations, as will be described in detail.

In the preferred embodiment the protuberance 68 on the second end 64 of the valve 46 located adjacent the mud second side 52 of the membrane 34 is a solid disk 72 as shown in FIG. 3. The protuberance 68 on the first end 62 of the valve 46 adjacent to the lubricant first side 50 of the membrane 34 may also be a solid disk 72, or may have one of the arrangements as shown in FIGS. 5–8.

Figure 6:
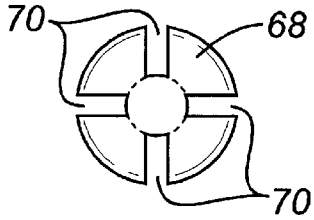
FIG. 6 is an end view of the valve of the preferred embodiment showing an alternate slot arrangement.
Figure 8:
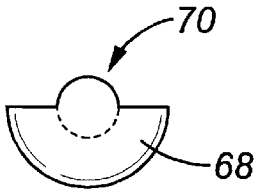
FIG. 8 is an end view of the valve of the preferred embodiment showing another alternate slot arrangement.
Figure 7:
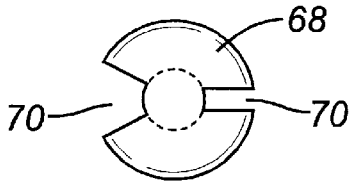
FIG. 7 is an end view of the valve of the preferred embodiment showing another alternate slot arrangement.

FIGS. 5–8 show various arrangements for the protuberances 68 of the valve 46. Notches 70 are formed by removing a portion of the solid disk 72. These notches 70 change the differential relief pressure of the valve 46 mounted in the membrane 34. In the preferred configuration shown in FIG. 5, a plurality of notches 70 are formed opposite each other from the disc 72 on first end 62 of the valve 46 mounted adjacent to the lubricant first side 50 of the aperture 48 of the membrane 34. The plurality of notches 70 allow differential pressure from the lubricant 32 to be exposed to the surface of the membrane 34 adjacent to the aperture 48. This allows the pressure to act more directly on the membrane 34. It is believed that as the area exposed by the notches increases, as shown in FIGS. 6–8, the relieving pressure decreases.

In operation the pressure of the lubricant 32 adjacent to the membrane 34 varies as the bit 10 drills, due to the mechanical piston effect of the rolling cutter 18 and lubricant 32 volume changes. The pressure of the drilling fluid also varies due to the hydrostatic pressure head of the fluid column and due to effects caused by the drilling and pumping action. Most of the time a pressure compensation device (well known in the art) can displace a volume of lubricant 32 in response to these pressure differences. This tends to equalize these pressure differentials.

However, at times, large transient differential pressures persist. When these transient pressure variations exceed a set difference the valve 46 and membrane 34 together act as a pressure relief device. When the transient pressure of the lubricant 32 becomes a predetermined amount greater than the drilling fluid, lubricant is expelled around the valve 46, through the aperture 48 into the drilling fluid. When the transient pressure of the drilling fluid becomes a predetermined amount greater than the lubricant 32, drilling fluid enters the bit 10 around the valve 46, through the aperture 48. The pre-determined differential pressure to expel the drilling fluid into the lubricant 32 is usually much higher than the pre-determined differential pressure to expel the lubricant 32 into the drilling fluid.

In order to assure the pressure is exerted properly on the membrane 34, the spacing between the ends 62, 64 of the valve 46 is made greater than the thickness of the membrane 34, such that a gap G as shown in FIG. 10 is left between one of the ends 62, 64 and the surface of the membrane 34 upon assembly. The amount of gap is not particularly critical, however a gap of between 0.002 inches and 0.025 inches has been found to be satisfactory.

In a series of tests the valve 46 and membrane 34 of the preferred embodiment were assembled and a series of relief pressure tests were run. A number of pieces were run in the tests, and the average relief pressure from the lubricant first side 50 to the second side 52 of the membrane was 70 +/−5 PSI differential. This compared to the 145 +/−35 PSI differential relief pressures found in bi-directional relief valves typical of those known in the prior art.

When the relief pressure was tested in the opposite direction, the valve 46 and membrane 34 had a relief pressure from the mud second side 52 to the lubricant first side 50 of the membrane of about 550 PSI differential.

Several different valve 46 and membrane 34 configurations were tested. In each case the part to part variation in the relief pressure was less than +/−5 PSI differential. In these tests, it was demonstrated that the relief pressures with this design could be controlled to as low as 37 +/−3 PSI differential. Lower relief pressures are possible, but because normal pressure fluctuations in rock bits in the 35 PSID range are readily tolerated, lower settings are not needed. However, may other types of downhole tools may well benefit from pressure relief settings lower than 37 PSID.

Other valve and aperture configurations are also possible. In FIGS. 11, and 13–19, an alternate configuration of relief device is shown. For ease of understanding, structures similar to those of the preferred embodiment have been identified by numerals increased by 100.

Figure 11:
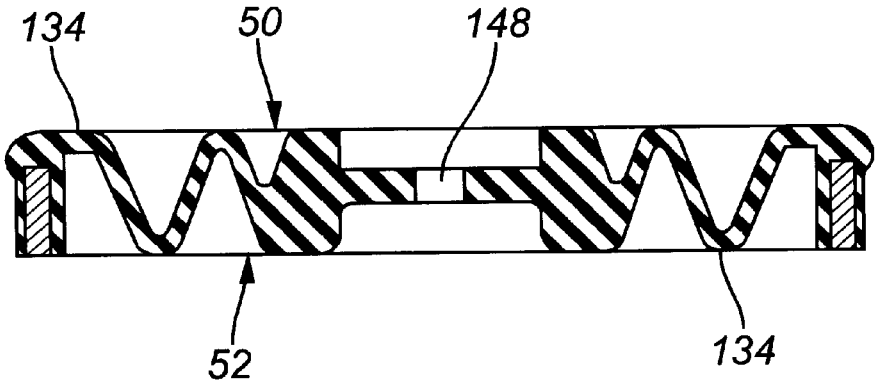
FIG. 11 is a cross-section view of the membrane showing an alternate configuration of the aperture.
Figure 13:
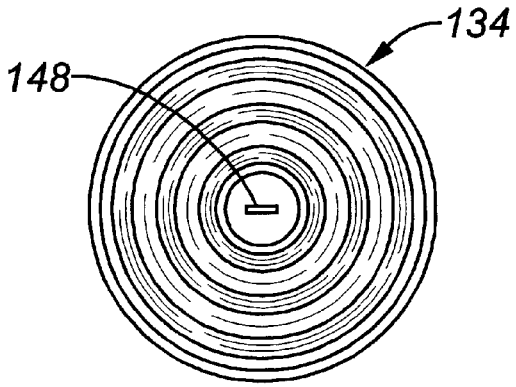
FIG. 13 is an end view of the membrane showing an alternate aperture configuration.
Figure 14:
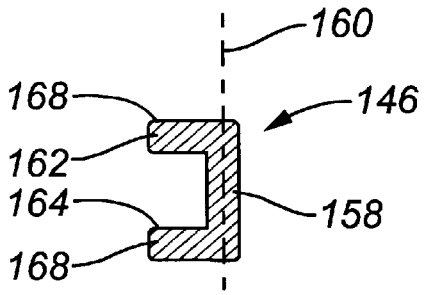
FIG. 14 is a side view of an alternate valve configuration.

In FIGS. 11 and 13, an elongated slot aperture 148 is formed in a membrane 134. The valve 146 has a flat elongated body 158, a longitudinal axis 160 a first end 162 and a second end 164. The valve 146 is inserted into the aperture 148 of the membrane 134 at assembly to effect a relief valve assembly as previously described. Each end 162, 164 of the body 158 has a protuberance 168 that extends a radial distance beyond the body 158 of the valve 146.

Figure 17:
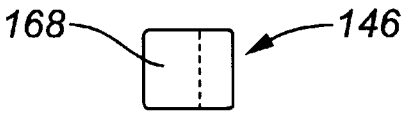
FIG. 17 is an end view of the valve shown in FIG. 14.
Figure 18:
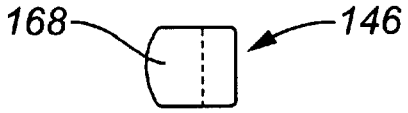
FIG. 18 is an alternate end view of the valve shown in FIG. 14.

FIGS. 17 and 18 show two of the many configurations of the protuberances 168. FIG. 17 shows a square ended protuberance 168 and FIG. 18 shows a protuberance 168 with a rounded end.

Figure 15:
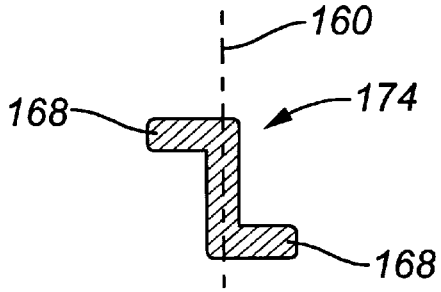
FIG. 15 is a side view of another alternate valve configuration.
Figure 16:
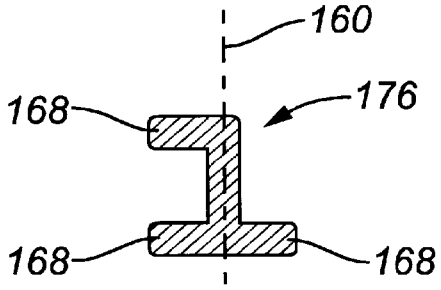
FIG. 16 is a side view of another alternate valve configuration.
Figure 19:
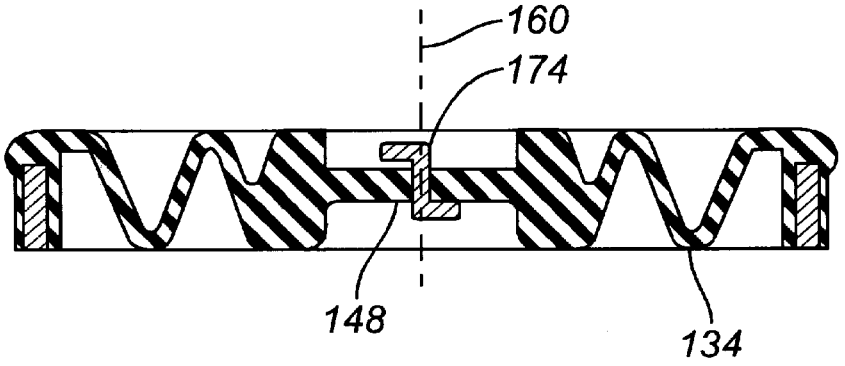
FIG. 19 is a cross-section view of an alternate embodiment of a membrane and valve arrangement.

Variations of valve 146 are shown as valve 174 in FIGS. 15 and 19 and valve 176 in FIG. 16. Each of these valves 146, 174, 176 and membrane 134 function in a similar manner as the valve 46 and membrane 34 of the preferred embodiment.

Although the preferred embodiment of the present invention has been shown and described in a rolling cutter drill bit with friction bearings, rigid face seals, and with rolling cutters having interferingly fitted teeth, the invention is not limited to these features. For instance, bits with other seal designs, such as single energizer face seals and packing ring type seals can benefit from the low pressure relief device disclosed. Similarly, the device will perform equally well in tooth type rolling cutter drill bits, as well as in bits with anti-friction bearing systems, or in any lubricated downhole tool.

Also, although the membrane 34, 134 has been shown as being an integral part of the lubricant pressure compensation device, it is possible to separate the two functions. For example the membrane 34, 134 and valve 46, 146, 174, 176 may be separate and distinct from the device which provides the lubricant pressure compensation.

Whereas the present invention has been described in particular relation to the drawings attached hereto, it should be understood that other and further modifications apart from those shown or suggested herein, may be made within the scope and spirit of the present invention.

What is claimed is:

1. A rolling cutter rock drill bit comprising a bit body, a lubricant reservoir formed in the bit body, a rolling cutter mounted upon the bit body, a dynamic seal sealingly disposed between the rolling cutter and the bit body, a lubricant, passaging within the bit body to effect fluid communication of the lubricant between the reservoir and the dynamic seal; an elastic membrane mounted on the bit body having a first side in fluid communication with the lubricant and a second side adapted for fluid communication with a drilling fluid, an aperture formed in the membrane, and a valve mounted in the aperture, the valve comprising an elongated body with a first end, a second end, a surface and a longitudinal axis, a protuberance on each of the ends of the valve, wherein each protuberance extends a radial distance beyond the surface of the elongated body with respect to the longitudinal axis of the elongated body and the protuberance on the first end of the valve is a disc with a plurality of notches and the protuberance on the second end of the valve is a solid disc.

2. The rolling cutter rock drill bit of claim 1 wherein the membrane has a thickness adjacent to the aperture, and there is a spacing between the first end of the valve and the second end of the valve wherein the spacing is made greater than the thickness of the membrane.

3. A rolling cutter rock drill bit comprising a bit body, a lubricant reservoir formed in the bit body, a rolling cutter mounted upon the bit body, a dynamic seal sealingly disposed between the rolling cutter and the bit body, a lubricant, passaging within the bit body to effect fluid communication of the lubricant between the reservoir and the dynamic seal;

an elastic membrane mounted on the bit body having a first side in fluid communication with the lubricant and a second side adapted for fluid communication with a drilling fluid, an aperture formed in the membrane, and a valve mounted in the aperture, the valve comprising an elongated body with a first end, a second end, a surface and a longitudinal axis, a protuberance on each of the ends of the valve, wherein each protuberance extends a radial distance beyond the surface of the elongated body with respect to the longitudinal axis of the elongated body, the aperture is an elongated slot, and the elongated body is a generally flat, elongated body.

4. A pressure relief device for a lubricant in a rolling cutter drill bit comprising an elastic membrane mounted in the bit, the membrane having a first side in fluid communication with the lubricant and a second side adapted for fluid communication with a drilling fluid, an aperture formed in the membrane, and a valve mounted in the aperture, the valve comprising a body with a first end, a second end, a surface, and a longitudinal axis, a protuberance on each of the ends of the valve, wherein each protuberance extends a radial distance beyond the surface of the body with respect to the longitudinal axis of the body, the protuberance on the first end of the valve is a disc with a plurality of notches and the protuberance on the second end of the valve is a solid disc.

5. The pressure relief device of claim 4 wherein the membrane has a thickness adjacent to the aperture, and there is a spacing between the first end of the valve and the second end of the valve wherein the spacing is made greater than the thickness of the membrane.

6. A pressure relief device for a lubricant in a rolling cutter drill bit comprising an elastic membrane mounted in the bit, the membrane having a first side in fluid communication with the lubricant and a second side adapted for fluid communication with a drilling fluid, an aperture formed in the membrane, and a valve mounted in the aperture, the valve comprising a body with a first end, a second end, a surface, and a longitudinal axis, a protuberance on each of the ends of the valve, wherein each protuberance extends a radial distance beyond the surface of the body with respect to the longitudinal axis of the body, the aperture is an elongated slot, and the body of the valve has a flat, elongated body.

7. A pressure relief device for a downhole tool with a lubricant sealed in the tool, the pressure relief device comprising an elastic membrane mounted in the tool with a first side in fluid communication with the lubricant and a second side exposed to a drilling fluid, an aperture formed in the membrane, and a valve mounted in the aperture, the valve comprising a body with a first end, a second end, a surface and a longitudinal axis, a protuberance on each of the ends of the valve, wherein each protuberance extends a radial distance beyond the surface of the body with respect to the longitudinal axis of the body, the protuberance on the first end of the valve is a disc with a plurality of notches, and the protuberance on the second end of the valve is a solid disc.

8. The pressure relief device of claim 3 wherein the membrane has a thickness adjacent to the aperture, and there is a spacing between the first end of the valve and the second end of the valve wherein the spacing is made greater than the thickness of the membrane.

9. A pressure relief device for a downhole tool with a lubricant sealed in the tool, the pressure relief device comprising an elastic membrane mounted in the tool with a first side in fluid communication with the lubricant and a second side exposed to a drilling fluid, an aperture formed in the membrane, and a valve mounted in the aperture, the valve comprising a body with a first end, a second end, a surface and a longitudinal axis, a protuberance on each of the ends of the valve, wherein each protuberance extends a radial distance beyond the surface of the body with respect to the longitudinal axis of the body, the aperture is an elongated slot, and the body of the valve has a flat, elongated body.

* * * * *